US005880078A

United States Patent [19]

Bevilacqua, Jr. et al.

[11] Patent Number: 5,880,078

[45] Date of Patent: Mar. 9, 1999

[54] NON-SOLVENT, GENERAL USE EXTERIOR AIRCRAFT CLEANER

[75] Inventors: Philip Bevilacqua, Jr., Lusby, Md.; Kenneth G. Clark, Chalfont, Pa.; David L. Gauntt, Leonard, Md.

[73] Assignee: The United States of America as represented by the Secretary of the Navy, Washington, D.C.

[21] Appl. No.: 932,795

[22] Filed: Sep. 4, 1997

[51] Int. Cl.[6] ..... C11D 1/72; C11D 1/94; C11D 3/28

[52] U.S. Cl. ..... 510/255; 510/245; 510/265; 510/266; 510/423; 510/433; 510/500; 510/501

[58] Field of Search ..... 510/245, 255, 510/265, 266, 423, 433, 500, 501

[56] References Cited

U.S. PATENT DOCUMENTS

| | | | |
|---|---|---|---|
| 3,210,286 | 10/1965 | Gangwisch et al. | 252/137 |
| 3,234,138 | 2/1966 | Carroll et al. | 252/110 |
| 3,240,715 | 3/1966 | Foley et al. | 252/152 |
| 3,655,566 | 4/1972 | Robinson et al. | 252/95 |
| 3,702,825 | 11/1972 | Von Der Eltz et al. | 252/89 |
| 4,104,187 | 8/1978 | Sibley et al. | 252/106 |
| 4,155,882 | 5/1979 | Davies et al. | 252/548 |
| 4,518,517 | 5/1985 | Eigen et al. | 252/107 |
| 4,559,227 | 12/1985 | Chandra et al. | 424/70 |
| 4,965,009 | 10/1990 | Baur et al. | 252/142 |
| 5,063,044 | 11/1991 | Kohl et al. | 424/70 |
| 5,248,388 | 9/1993 | Richmann et al. | 162/5 |
| 5,326,483 | 7/1994 | Halloran et al. | 252/174.15 |
| 5,534,181 | 7/1996 | Henkel et al. | 510/423 |
| 5,707,550 | 1/1998 | Glover et al. | 252/307 |
| 5,723,111 | 3/1998 | Glover et al. | 424/70.1 |

*Primary Examiner*—Paul Lieberman
*Assistant Examiner*—Gregory R. Delcotto
*Attorney, Agent, or Firm*—Ron Billi

[57] ABSTRACT

The present invention relates to a cleaning composition having utility in cleaning aircraft exterior surfaces. The cleaning composition comprises from about 15% to about 40% of a mixture of linear alcohol ethoxylates having a HLB in the range of about 5.0 to about 15.0, from about 5% to about 25% capric diethanolamide, and the balance water. The mixture of linear alcohol ethoxylates comprises from about 5% to about 15% of a first linear alcohol ethoxylate having a HLB in the range of about 5.0 to 9.5 and from about 10% to about 25% of a second linear alcohol ethoxylate having a HLB in the range of about 10 to 15. The cleaning composition also includes from about 0.1% to about 5% of capryloamphopropionate, from about 0.1% to about 5.0% benzotriazole, from about 0.1% to about 5.0% of an inhibitor for reducing corrosion of magnesium parts, and from about 0.1% to about 5.0% of an inhibitor for reducing corrosion of cadmium plated steel parts.

16 Claims, No Drawings

NON-SOLVENT, GENERAL USE EXTERIOR AIRCRAFT CLEANER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a solvent-free, biodegradable cleaning composition having particular utility in the cleaning of painted and unpainted exterior aircraft surfaces and to a method for applying the cleaning composition to the exterior aircraft surfaces.

(2) Description of the Prior Art

There are many different types of cleaning compositions known in the art. U.S. Pat. Nos. 3,234,138 to Carroll, 3,240,715 to Foley, and 5,534,181 to Henkel et al. illustrate some of these compositions. The Carroll patent illustrates a detergent composition for cleaning hard surfaces. The detergent composition includes an inorganic phosphate component, an ethanolamide nonionic detergent component, a low molecular weight soap component and water. The Foley patent relates to a liquid detergent composition comprising a mixture of diethanolamides of higher fatty acids of 10–22 carbons containing hydroxy substituents, and at least 1% by weight based on the diethanolamides of dicarboxylic aliphatic acids of about 6–13 carbons and diethanolamide salts of higher monocarboxylic acids of 10–22 carbons containing hydroxy substituents. The Henkel et al. patent relates to a cleaning composition containing from about 0.4% to about 5.0% of an alkali metal salt, from about 0.3% to about 4.0% of a nonionic fatty acid amide, from about 0.3% to about 4% of an iso-fatty acid, from about 2% to about 7% of a builder, from about 1% to about 15% of a glycol ether, from about 1% to about 15% of a nonionic surfactant, and from about 50% to about 95% water.

Existing products used to clean the exterior of Navy aircraft are formulated with a solvent content of 10 to 15% and include other constituents that are cause for environmental concern. Propylene class glycol ether coupling solvents included in existing products to improve cleaning performance and thermal stability are volatile organic compounds (VOCs). Furthermore, glycol ether solvents typically have low permissible exposure limits (PELS) on the order of 100 ppm contributing to workplace health hazards.

A vapor phase corrosion inhibitor, morpholine, included in existing products to protect partially filled steel drums from corrosion at the liquid-vapor interface is also a VOC and listed as a hazardous air pollutant (HAP) by the 1990 Clean Air Act.

Finally, a typical surfactant component of the existing cleaners contains a phenoxyl group in the chemical structure. During biodegradation this is thought to produce phenol, a compound toxic to bacteria vital to the biodegradation process. This may result in waterway pollution and cause difficulty in waste treatment operations.

SUMMARY OF THE INVENTION

Accordingly, it is an object of the present invention to provide a cleaning composition suitable for cleaning exterior aircraft surfaces.

It is a further object of the present invention to provide a cleaning composition as above which does not give rise to environmental concerns.

It is also an object of the present invention to provide a cleaning composition as above which has improved cleaning ability.

It is still another object of the present invention to provide a cleaning composition as above which promotes worker safety and comfort.

The foregoing objects are attained by the cleaning compositions of the present invention.

In accordance with the present invention, cleaning compositions suitable for cleaning exterior surfaces of an aircraft comprise from about 15% to about 40% of a mixture of linear alcohol ethoxylates having a hydrophilic-lipophilic balance (HLB) in the range of about 8.5 to about 12.5, from about 5% to about 25% capric diethanolamide, and the balance water. The mixture of linear alcohol ethoxylates comprises from about 5% to about 15% of a first linear alcohol ethoxylate having a HLB in the range of about 5.0 to 10.5 and from about 10% to about 25% of a second linear alcohol ethoxylate having a HLB in the range of about 11 to 15. The cleaning composition also includes from about 0.1% to about 5% of capryloamphopropionate, from about 0.1% to about 5.0% benzotriazole, from about 0.1% to about 5.0% of a phosphate ester and triazole inhibitor for reducing corrosion of magnesium parts, and from about 0.1% to about 5.0% of a carboxylic acid derivative inhibitor for reducing corrosion of cadmium plated steel parts.

As used herein, the percentages of the constituents, unless otherwise noted , are weight percentages.

Other details of the cleaning composition of the present invention, as well as other objects and advantages attendant thereto, are set forth in the following detailed description.

DETAILED DESCRIPTION OF THE PREFERRED EMBODIMENT(S)

As previously discussed, the present invention relates to a cleaning composition suitable for use in cleaning aircraft exterior surfaces. The cleaning composition is also made from constituents which yield a product which is environmentally sound and biodegradable.

The cleaning composition of the present invention takes into account several considerations. First, it takes into consideration the need to eliminate any solvent coupling agent from the formulation. Second, it takes into account that surface active agents (surfactants) must be selected so as to maximize cleaning performance of the compound while maintaining stability. Third, it takes into account the need to minimize damage to structural materials. Corrosion is a constant concern due to the extremely harsh operating environment of Navy aircraft. Excessive damage to structural materials could have great costs in terms of actual loss of aircraft components and personnel safety.

Linear alcohol ethoxylate surfactants have been found to be effective cleaning agents on the types of soil encountered by Naval aircraft. However, they have some deficiencies. For example, without the inclusion of a solvent in the formulation these surfactants did not achieve a desired level of cleaning effectiveness. In addition, the foamability of these components was inadequate. Foaming of the cleaning compound becomes important during the application process, where the cleaning composition is expected to cling to vertical aircraft surfaces when applied with a portable foam generating unit.

The addition of capric diethanolamide surfactant to the cleaning composition of the present invention circumvented the shortcomings of the linear alcohol ethoxylates, improving both the cleaning performance and the foamability of the cleaning composition. A drawback of this surfactant however is an increased deleterious effect on magnesium alloys and an increase in the pH of the formula. Cleaner pH must be kept low to avoid damage to aluminum alloys and polyimid-insulated wiring.

In the cleaning compositions of the present invention, a mixture of two linear alcohol ethoxylates having a HLB in the range of about 5 to 15 are used in the formulation. The linear alcohol ethoxylates are selected so that they are stable from a temperature standpoint, yet effective to clean the soils normally encountered on aircraft exterior surfaces. The mixture of the ethoxylates may comprise a first linear alcohol ethoxylate having a HLB in the range of about 5.0 to 10.5, preferably from about 8.5 to 10.5 and a second linear alcohol ethoxylate having a HLB in the range of about 11 to 15, preferably from about 11 to 12.5. The first linear alcohol ethoxylate is present in an amount from about 5% to about 15%, preferably from about 7.5% to about 9.5%. The second linear alcohol ethoxylate is present in an amount from about 10% to about 25%, preferably from about 17.4% to about 19.4%. The ratio of the first linear alcohol ethoxylate to the second linear alcohol ethoxylate should be such that the cleaning effectiveness of the cleaning composition is maximized, while the high temperature thermal stability of the final formulation is maintained. Preferably, the ratio of the first linear alcohol ethoxylate to the second linear alcohol ethoxylate is in the range of about 1:1.67 to about 1:2.

Capric diethanolamide is present in the cleaning compositions of the present invention in order to improve the cleaning performance and the foaming ability of the formulation. The capric diethanolamide is present in an amount from about 5.0% to about 25%, preferably from about 14% to about 16%.

The cleaning compositions also contains inhibitors for reducing corrosion on aluminum, magnesium and cadmium plated steel. The inhibitors are present in an amount from about 0.3% to about 15%, preferably from about 0.3% to about 3.0%. In a preferred embodiment of the present invention, the cleaning composition contains from about 0.1% to about 5.0%, preferably from about 0.1% to about 1.0% benzotriazole to protect against the corrosion of aluminum components, from about 0.1% to about 5.0%, preferably from about 0.1% to about 1.0%, of a phosphate ester and triazole inhibitor which prevents corrosion of magnesium components, such as an inhibitor sold by Sandoz under the tradename SANDOCRIN 8160, and from about 0.1% to about 5.0%, preferably from about 0.1% to about 1.0%, of a carboxylic acid derivative inhibitor for preventing the corrosion of cadmium plated steel, such as the inhibitor sold by Hoechst Celanese under the tradename HOSTACOR 2098.

Capryloamphopropionate, an amphoteric surfactant, may be added to the cleaning composition to eliminate the need for a vapor-phase corrosion inhibitor to protect steel. When added to the cleaning composition of the present invention, capryloamphopropionate may be present in an amount from about 0.1% to about 5.0%, preferably from about 0.5% to about 1.5%.

The balance of the cleaning composition formulation is water which may be present in an amount from about 40% to about 70%.

A cleaning composition which has been found to be useful in cleaning aircraft surfaces is one having the following formulation: 8.5% linear alcohol ethoxylate having a HLB of 8.5, 18.4% linear alcohol ethoxylate having a HLB of 12.5, 15% capric diethanolamide, 1.0% capryloamphopropionate, 0.7% benzotriazole, 0.7% Sandocorin 8132, 0.7% Hostacor 2098, and the balance water.

Cleaning compositions in accordance with the present invention are characterized by a pH of 10 or less. Preferably, the pH is in the range of about 7.0 to about 10.0. Most preferably, the pH is in the range of about 8.5 to about 9.0.

The cleaning compositions of the present invention may be used as follows.

1) Concentration: Light Soil—Mix 1 part cleaning composition in 14 parts water; Moderate Soil—Mix 1 part cleaning composition in 9 parts water; Heavy Soil —Mix 1 part cleaning composition in 4 parts water.

2) Apply with foam generator, spray-applicator, sponge, brush, or cloth. Scrub, then rinse with fresh water.

The cleaning compositions of the present invention offer a number of advantages. First, they demonstrate an improved cleaning ability over existing cleaning products conforming to MIL-C-85570B. Second, they do not contain solvents or have a high pH, i.e. <10. Third, they conform to all other requirements of MIL-C-85570B.

The cleaning compositions of the present invention also eliminate glycol ether coupling solvents through optimization of a surfactant blend. This eliminates the use of a VOC and improves worker safety and comfort.

The cleaning compositions of the present invention also do not use a surfactant containing a phenoxy group. This improves the biodegradability of the cleaning compositions.

The cleaning compositions of the present invention also replace morpholine vapor-phase corrosion inhibitor, a VOC, with capryloamphopropionate, an amphoteric surfactant, to protect partially filled steel drums. Corrosion protection is thought to be obtained through the ability of this surfactant to adsorb onto both positively and negatively charged sites of the steel surface.

The cleaning compositions of the present invention have been found to achieve a 50% increase in product efficiency. The cleaning composition, when diluted 1:14 with water, obtains a higher level of cleaning performance than the existing formulation diluted 1:9 with water. This results in a substantial reduction of packaging and shipping costs.

It is apparent that there has been provided in accordance with the present invention a non-solvent general use aircraft exterior cleaner which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A cleaning composition comprising:

from about 15% to about 40% of a mixture of linear alcohol ethoxylates having a HLB in the range of about 5.0 to about 15.0;

from about 14% to about 25% capric diethanolamide; from about 0.1% to about 5% of an amphoteric surfactant; from about 0.3% to about 15% of corrosion inhibitors for reducing corrosion on aluminum, magnesium, and cadmium plated steel; and the balance water.

2. The cleaning composition of claim 1 wherein said mixture of linear alcohol ethoxylates comprises a first linear alcohol ethoxylate having a HLB in the range of about 5.0 to 10.5 and a second linear alcohol ethoxylate having a HLB in the range of about 11 to 15.

3. The cleaning composition of claim 1 wherein said first linear alcohol ethoxylate has a HLB in the range of about 8.5 to 10.5 and the second linear alcohol ethoxylate has a HLB in the range of about 11 to 12.5.

4. The cleaning composition of claim 2 wherein the ratio of said first linear alcohol ethoxylate to the second linear alcohol ethoxylate is in the range of from about 1:1.67 to about 1:2.

5. The cleaning composition of claim 2 wherein said first linear alcohol ethoxylate is present in an amount from about 5% to about 15% and the second linear alcohol ethoxylate is present in an amount from about 10% to about 25%.

6. The cleaning composition of claim 2 wherein said first linear alcohol ethoxylate is present in an amount from about 7.5% to about 9.5% and said second linear alcohol ethoxylate is present in an amount from about 17% to about 19.5%.

7. The cleaning composition of claim 1 wherein said capric diethanolamide is present in an amount from about 14% to about 16%.

8. The cleaning composition of claim 7 wherein said amphoteric surfactant is capryloamphopropionate.

9. The cleaning composition of claim 8 wherein said capryloamphopropionate is present in an amount from about 0.5% to about 1.5%.

10. The cleaning composition of claim 1 comprising from about 0.1% to about 5.0% benzotriazole for reducing corrosion of aluminum aircraft components, from about 0.1% to about 5.0% of a phosphate ester and triazole inhibitor for reducing corrosion of magnesium aircraft components, and from about 0.1% to about 5.0% of a carboxylic acid derivative inhibitor for reducing corrosion of cadmium plated steel aircraft parts.

11. The cleaning composition of claim 10 wherein said benzotriazole is present in an amount from about 0.1% to about 1.0%, said phosphate ester and triazole inhibitor is present in an amount from about 0.1% to about 1.0%, and said carboxylic acid derivative inhibitor is present in an amount from about 0.1% to about 1.0%.

12. The cleaning composition of claim 1 wherein the pH of said cleaning composition is less than 10.

13. The cleaning composition of claim 1 wherein the pH of said cleaning composition is in the range of from about 7.0 to about 10.

14. The cleaning composition of claim 1 wherein the pH of the cleaning composition is in the range of from about 8.5 to about 9.0.

15. A composition for cleaning exterior aircraft surfaces, said composition comprising:

from about 5% to about 15% of a linear alcohol ethoxylate having a HLB in the range of about 5.0 to 10.5;

from about 10% to about 25% of a linear alcohol ethoxylate having a HLB in the range of about 11 to 15;

from about 14% to about 25% capric diethanolamide;

from about 0.1% to about 5.0% capryloamphopropionate;

from about 0.1% to about 5.0% benzotriazole;

from about 0.1% to about 5.0% of an inhibitor for reducing corrosion on magnesium parts;

from about 0.1% to about 5.0% of an inhibitor for reducing corrosion on cadmium plated steel parts; and the balance water.

16. A composition for cleaning exterior surfaces on aircraft, said composition comprising:

from about 7.5% to about 9.5% of a linear alcohol ethoxylate having a HLB in the range of about 8.5 to 10.5;

from about 17% to about 19.5% of a linear alcohol ethoxylate having a HLB in the range of about 11 to 12.5;

from about 14% to about 16% capric diethanolamide;

from about 0.5% to about 1.5% capryloamphopropionate;

from about 0.1% to about 1.0% benzotriazole;

from about 0.1% to about 1.0% of an inhibitor for reducing corrosion of magnesium parts;

from about 0.1% to about 1.0% of an inhibitor for reducing corrosion of cadmium plated steel parts; and the balance water.

* * * * *